US010598350B2

(12) United States Patent
Ji et al.

(10) Patent No.: US 10,598,350 B2
(45) Date of Patent: Mar. 24, 2020

(54) STRIP LAMP, ASSEMBLY METHOD AND DISASSEMBLY METHOD THEREOF

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Feng Ji, Zhejiang (CN); Zhaoyong Zheng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/182,164

(22) Filed: Nov. 6, 2018

(65) Prior Publication Data

US 2019/0162391 A1 May 30, 2019

(30) Foreign Application Priority Data

Nov. 28, 2017 (CN) ..... 2017 1 1210156

(51) Int. Cl.
*F21V 15/01* (2006.01)
*F21V 17/16* (2006.01)
*F21V 21/03* (2006.01)

(52) U.S. Cl.
CPC ..... *F21V 15/01* (2013.01); *F21V 17/164* (2013.01); *F21V 21/03* (2013.01)

(58) Field of Classification Search
CPC ..... F21V 17/164; F21V 17/18; F21V 17/16; F21V 21/025; F21V 21/005
USPC ..... 362/217.1, 217.13
See application file for complete search history.

(56) References Cited

U.S. PATENT DOCUMENTS

| | | | | |
|---|---|---|---|---|
| 8,794,817 | B2 * | 8/2014 | Pearson | F21V 21/088 362/235 |
| 8,864,347 | B2 * | 10/2014 | Pearson | F21S 2/005 362/362 |
| 9,062,840 | B2 * | 6/2015 | Swisha | F21V 21/02 |
| 10,203,077 | B1 * | 2/2019 | Bremser | F21S 8/036 |
| 2011/0222268 | A1 * | 9/2011 | Pearson | F21S 8/033 362/119 |
| 2014/0092596 | A1 * | 4/2014 | Deutsch | F21S 4/28 362/236 |

* cited by examiner

*Primary Examiner* — William N Harris
(74) *Attorney, Agent, or Firm* — Wang Law Firm, Inc.

(57) ABSTRACT

A strip lamp made for easy assembly and disassembly contains a U-shaped groove body and a cover made for covering the groove body. The groove body and the cover are attached by a latch on the cover and a matching lock on the groove body on one side, and a pivot made by a V-shaped groove on the cover on the other side. Assembly can be conducted without the use of fasteners so that the strip lamp may be easily assembled.

10 Claims, 5 Drawing Sheets

STRIP LAMP, ASSEMBLY METHOD AND DISASSEMBLY METHOD THEREOF

CROSS-REFERENCE TO A RELATED APPLICATION

This application claims priority to a Chinese Patent Application No. CN 201711210156.2, filed on Nov. 28, 2017.

FIELD OF THE TECHNOLOGY

The present invention relates to lighting device, with particular emphasis on a strip lamp, assembly method and disassembly method thereof.

BACKGROUND

In general daily life, various lighting devices can be seen everywhere, such as fluorescent lamps, street lamps, table lamps, art lamps, and the like. In the above lighting apparatus, a tungsten filament bulb is conventionally used as a light source. In recent years, due to the rapid development of technology, light-emitting diodes (LEDs) have been used as sources of illumination. In addition, in addition to lighting equipment, for general traffic signs, billboards, lights, etc., also use LEDs as a light source. As mentioned above, the use of light-emitting diodes as light-emitting sources has the advantages of power saving and greater brightness, so it has gradually become common in use. As people's living standards become higher and higher, they no longer only need to meet the needs of lighting, but also pay more and more attention to the beauty of the lamps, as well as the assembly, disassembly and installation of the lamps.

SUMMARY OF THE INVENTION

Therefore, the present invention provides an optimized strip lamp, assembly method and disassembly method thereof to solve the above problem.

A strip lamp comprises a groove body, a cover body covering the groove body, and at least one latching member disposed on the cover body, the groove body includes a first side wall, and a second side wall, the first side wall includes a blocking portion extending toward the second side wall in a section perpendicular to an extending direction of the groove body, the second side wall includes a latching edge extending toward the first side wall, and the latching member includes a body, a latching portion extending perpendicular to the body and engaging with the latching edge, and a V-shaped latching groove provided in cooperation with the blocking portion, the latching portion includes a connecting edge connected to the body, and a right-angled triangular portion, a right-angled side of the right-angled triangular portion and the connecting edge is connected, the other right-angled side is engaged with the latching edge, the V-shaped latching groove is latched on the blocking portion and includes a first side connected to the body, and a second side connected to the first side, the angle between the first side and the body is an obtuse angle in a section perpendicular to the extending direction of the groove body, and the second side is spaced apart from the cover body.

Advantageously, the connecting edge is perpendicular to the body.

Advantageously, the first side wall further includes an abutting portion in a section perpendicular to the extending direction of the groove body, and a transition portion connecting the abutting portion and the blocking portion.

Advantageously, the transition portion is an arc.

Advantageously, the extending direction of the abutting portion is perpendicular to the extending direction of the blocking portion.

Advantageously, the distance between the second side and the cover body is equivalent to the wall thickness of the blocking portion.

Advantageously, the maximum distance of the blocking portion from the cover body is equivalent to the maximum distance of the latching portion from the cover body.

Advantageously, the second side wall further includes at least one detaching hole, and a central axis of the detaching hole intersects a hypotenuse of the right-angled triangular portion in a section perpendicular to an extending direction of the groove body.

An assembly method of the strip lamp includes the following steps:

Providing a groove body, the groove body including a first side wall, and a second side wall, in a section perpendicular to the extending direction of the groove body, the first side wall includes a blocking portion extending toward the second side wall, the second side wall includes a latching edge extending toward the first side wall;

Providing a cover body;

Providing a latching member disposed on the cover body, the latching member includes a body, and a latching portion extending perpendicular to the body and engaging with the latching edge, and a V-shaped latching groove disposed in cooperation with the blocking portion, the latching portion includes a connecting edge connected to the body, and a right-angled triangular portion, a right-angled side of the right-angled triangular portion and the connecting edge is connected, the other right-angled side is engaged with the latching edge, the V-shaped latching groove is latched on the blocking portion and includes a first side connected to the body, and a second side connected to the first side, the angle between the first side and the body is an obtuse angle in a section perpendicular to the extending direction of the groove body, and the second side is spaced apart from the cover body;

Insert the blocking portion into the gap between the second side of the V-shaped latching groove and the cover body;

Rotating the cover body with the free side of the second side as a center, and the inclined surface of the right-angled triangular portion is in contact with the latching edge;

Press the cover body to insert a right-angled side of the right-angled triangular portion on the latching edge to assemble the cover body onto the groove body to complete the assembly of the strip lamp.

A disassembling method of the strip lamp includes the following steps:

Providing a strip lamp, the strip lamp includes a groove body, a cover body covering on the groove body, and at least one latching member disposed on the cover body, the groove body includes a first side wall, and a second side wall, the first side wall includes a blocking portion extending toward the second side wall in a section perpendicular to an extending direction of the groove body, the second side wall includes a latching edge extending toward the first side wall, and the latching member includes a body, a latching portion extending perpendicular to the body and engaging with the latching edge, and a V-shaped latching groove provided in cooperation with the blocking portion, the latching portion includes a connecting edge connected to the body, and a right-angled triangular portion, a right-angled side of the right-angled triangular portion and the connecting edge is connected, the other right-angled side is engaged with the latching edge, the V-shaped latching groove is latched on the blocking portion and includes a first side connected to the body, and a second side connected to the first side, the angle between the first side and the body is an obtuse angle in a section perpendicular to the extending direction of the groove body, and the second side is spaced apart from the cover body, the second side wall further includes at least one detaching hole, and a central axis of the detaching hole intersects a hypotenuse of the right-angled triangular portion in a section perpendicular to an extending direction of the groove body;

Providing a lever having a diameter corresponding to a diameter of the detaching hole;

Insert the lever into the detaching hole, and the insertion direction of the lever intersects with the central axis of the detaching hole to abut the side wall of the lever at the free side of the right-angled triangular portion;

The lever is tilted to disengage the right-angled triangular portion of the latching portion from the latching edge;

Rotate the cover body with the free side of the second side as a center to pry the cover body from the groove body.

Compared with the prior art, since the first and second side walls and of the groove body are respectively provided with the blocking portion, the latching member is provided with the latching portion and the V-shaped latching groove, so that the cover body can cover the cover body on the groove body without any fasteners, so that the assembly method is simple and convenient, and it is convenient when disassembling, as long as one root lever is inserted into the detaching hole, so that the cover body can be detached from one side of the groove body, and the other side of the groove body is not detached by the V-shaped latching groove and the blocking portion, thereby facilitating the installation and maintenance of the strip lamp.

DETAILED DESCRIPTION OF THE DRAWINGS

The drawings described herein are intended to promote a further understanding of the present invention, as follows.

DESCRIPTION OF THE PREFERRED EMBODIMENTS

The present application is illustrated by way of the following detailed description based on of the accompanying drawings. It should be noted that illustration to the embodiment in this application is not intended to limit the invention.

Figure 1:
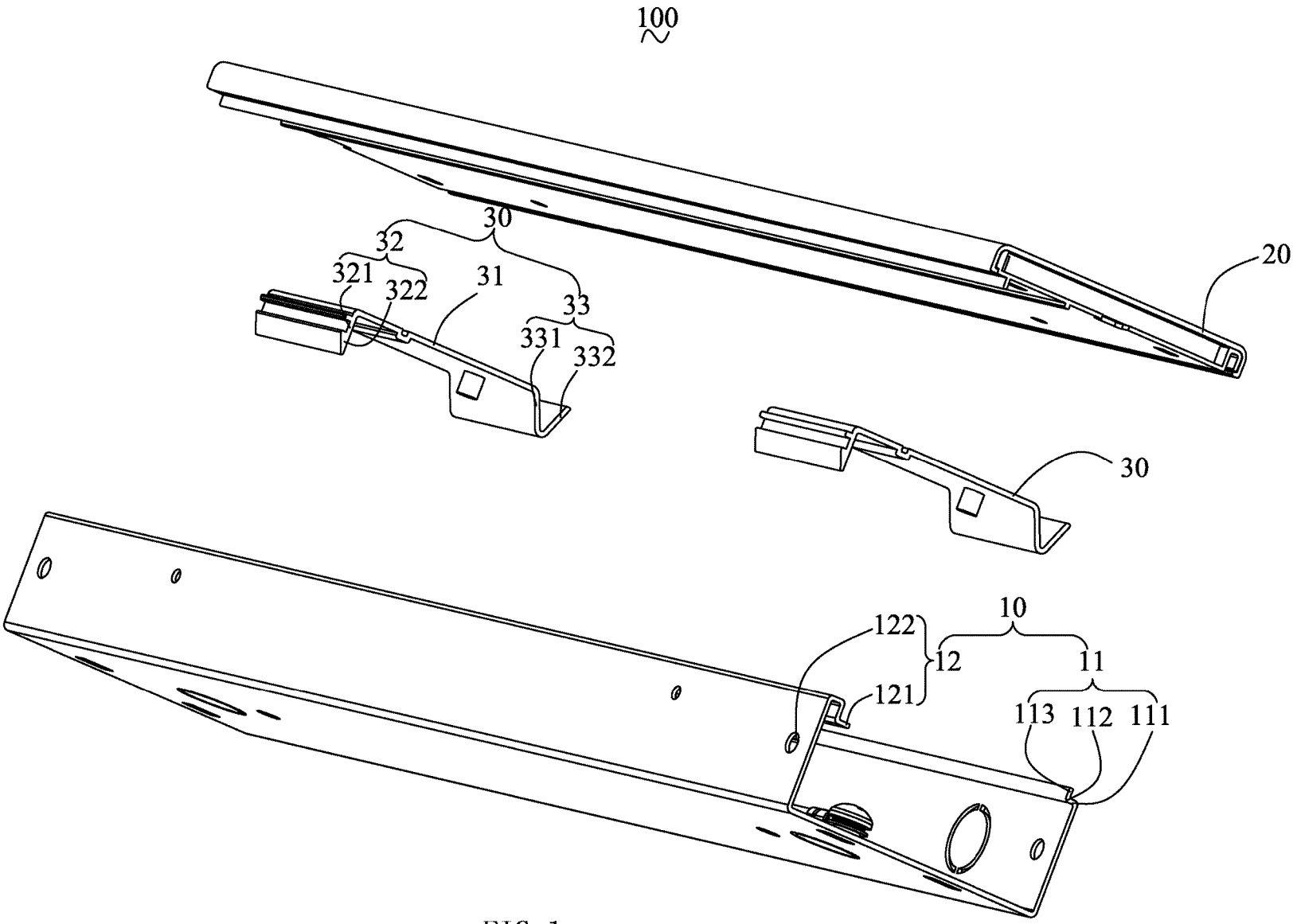
FIG. 1 is a schematic exploded view of a strip lamp provided by the present invention.
Figure 2:
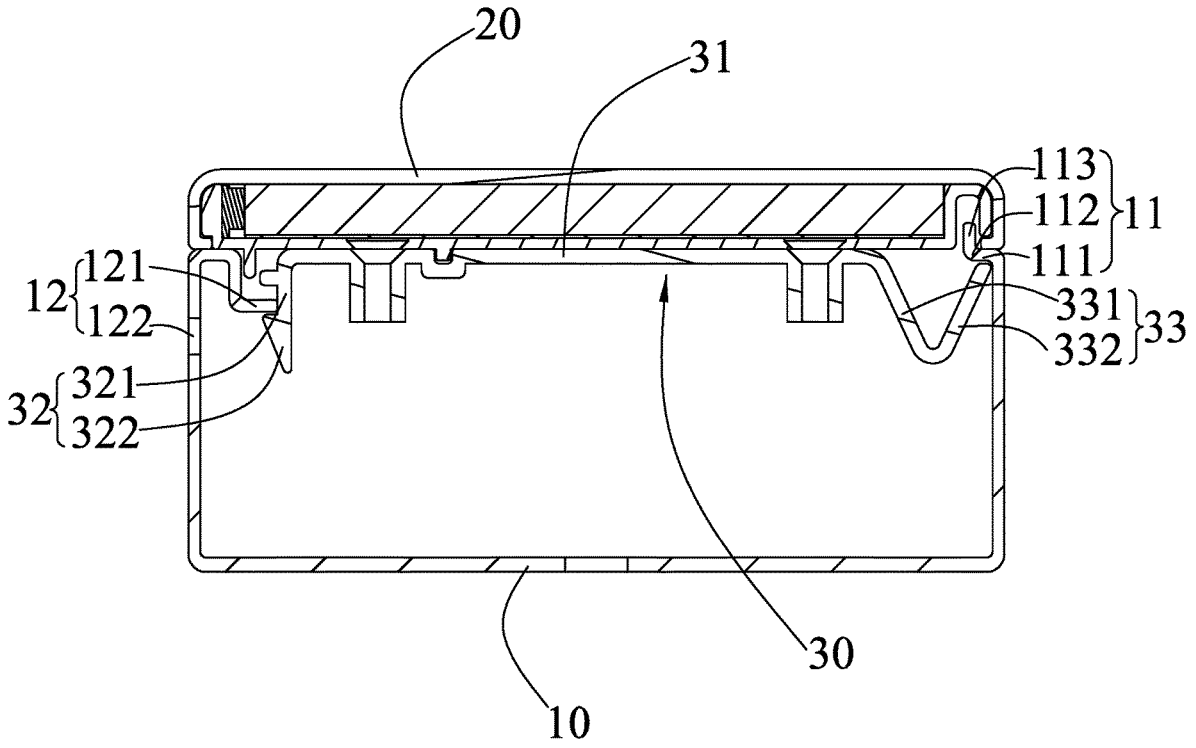
FIG. 2 is a schematic view showing the assembled structure of the strip lamp of FIG. 1.
Figure 3:
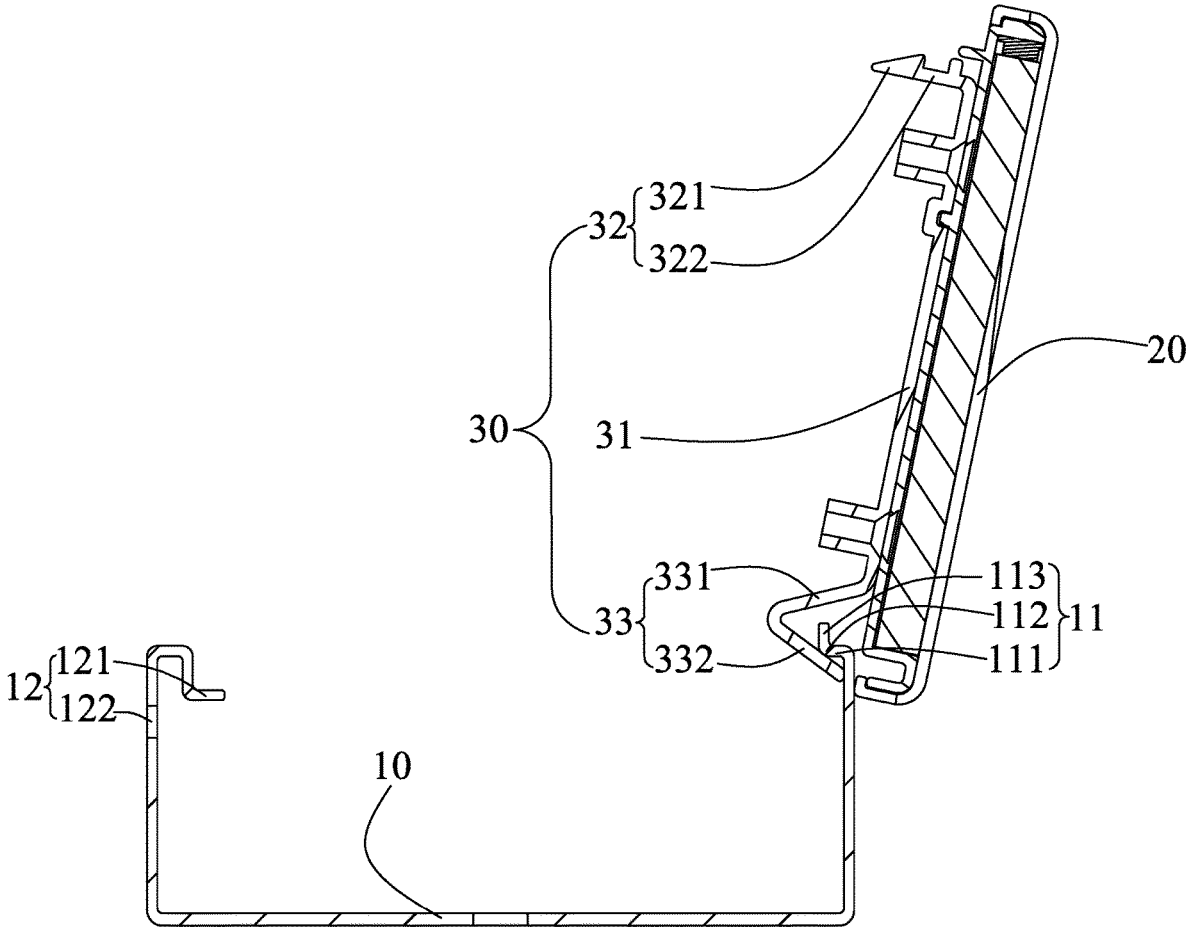
FIG. 3 is a schematic structural view of the strip lamp of FIG. 1 after disassembly.

Please refer to FIG. 1 to FIG. 3, which are schematic structural diagrams of a strip lamp 100 according to the present invention. The strip lamp 100 includes a groove body 10, a cover body 20 that is disposed on the groove body 10, and at least one latching member 30 disposed on the cover body 20. It is conceivable that the strip lamp 100 further includes a light source module housed in the groove body 10, a circuit connector module, and an end cover disposed at both ends of the groove body 10, etc., but It has common functional modules for general lamps and is known to those skilled in the art and will not be described in detail herein.

The groove body 10 includes a first side wall 11 and a second side wall 12 spaced apart from the first side wall 11. It is of course conceivable that the groove body 10 further comprises a bottom (not labeled in the figure) connecting the first and second side walls 11, 12 to form a channel structure. The first side wall 11 includes a blocking portion 111 extending toward the second side wall 12, a abutting portion 112, and a transition portion 113 connecting the abutting portion and the blocking portion 111 in a section perpendicular to the extending direction of the groove body 10. The function and structure of the blocking portion 111 will be described in detail below in conjunction with the structure of the latching member 30. It should be noted that the extending direction of the blocking portion 111 may be perpendicular to the second side wall 12 or may be form a hook with the first side wall 11 to enable the latching member 30 to be more firmly stuck. The abutting portion 112 is used to abut the cover body 20 to support the cover body 20 to maintain the phase position of the cover body 20. The extending direction of the abutting portion 112 will be perpendicular to the extending direction of the blocking portion 111 and extend toward the direction of the cover body 20. The transition section 113 can be an arc to facilitate processing, and its function is only to connect the abutting portion 112 and the blocking portion 111. It is of course conceivable that the transition portion 113 can also be a right angle. The second side wall 12 includes a latching edge 121 extending toward the first side wall 11. The latching edge 121 can extend directly from a free edge of the first side wall 11 to the direction perpendicular to the first sidewall 11. However, in the embodiment, in order to cooperate with the latching member 30, the latching edge 121 is a "Z" shape, and a free edge of the "Z" shaped latching edge 121 is connected with the free edge of the second side wall 12, the other free edge of the "Z" shaped latching edge 121 projects into the interior of the groove body 10. The second side wall 12 further includes at least one detaching hole 122. The central axis of the detaching hole 122 intersects the hypotenuse of the right-angled triangular portion 322 described below in a section perpendicular to the extending direction of the groove body 10. The action of the detaching hole 122 will be described in detail in the following disassembly method. It is conceivable that the maximum distance of the blocking portion 111 from the cover body 20 is equivalent to the maximum distance of the latching edge 121 from the cover body 20, so that the cover body 20 can be placed smoothly.

The latching member 30 includes a body 31, a latching portion 32 extending perpendicularly to the body 31 and mating with the latching edge 121, and a V-shaped latching groove 33 disposed in cooperation with the blocking portion 111. The body 31 is disposed on the cover body 20, and the connection method thereof may be a screw connection or a rivet connection or the like. The latching portion 32 is disposed at one side of the body 31 and includes a connecting edge 321 connected to the body 31, and a right-angled triangular portion 322. The connecting edge 321 is configured to extend the right-angled triangular portion 322 into the groove body 10, so that the length of the connecting edge 321 in a cross section perpendicular to the extending direction of the groove body 10 is engaged with the distance from the latching edge 121 to the free edge of the second side wall 12 is comparable. One right-angled side of the right-angled triangular portion 322 is connected to the connecting edge 321, and the other right-angled side is engaged with the latching edge 121. According to the positioning relationship described above, the hypotenuse of the right-angled triangular portion 322 can only be disposed toward the latching edge 121 relative to the right-angled side, and it is impossible to be disposed on backward direction of the right-angled side. The V-shaped latching groove 33 includes a first side 331 connected to the body 31 and a second side 332 connected to the first side 331. The angle between the first side 331 and the body 31 is an obtuse angle in a section perpendicular to the extending direction of the groove body 10, and the second side 332 is spaced apart from the cover body 20. The V-shaped latching groove 33 is clamped on the blocking portion 111. The distance between the second side 332 and the cover body 20 is equivalent to the thickness of the blocking portion 111, so that the blocking portion 111 can be inserted into the V-shaped snap groove 33 from the gap between the second side 332 and the cover body 20. The number of the latching members 30 is set according to actual needs, such as the length of the groove body 10. In the embodiment, the strip lamp has two latching members 30 spaced apart from the cover body 20.

The cover body 20 is disposed on the groove body 10. In the embodiment, the side of the cover body 20 facing away from the groove body 10 is provided with a light source module, a lamp cover and the like. Since the latching member 30 is disposed on the cover body 20, the cover body 20 can be set on the groove body 10 when the latching portion 32 of the latching member 30 and the V-shaped latching groove 33 are respectively engaged on the latching edge 121 and the blocking portion 111.

Figure 4:
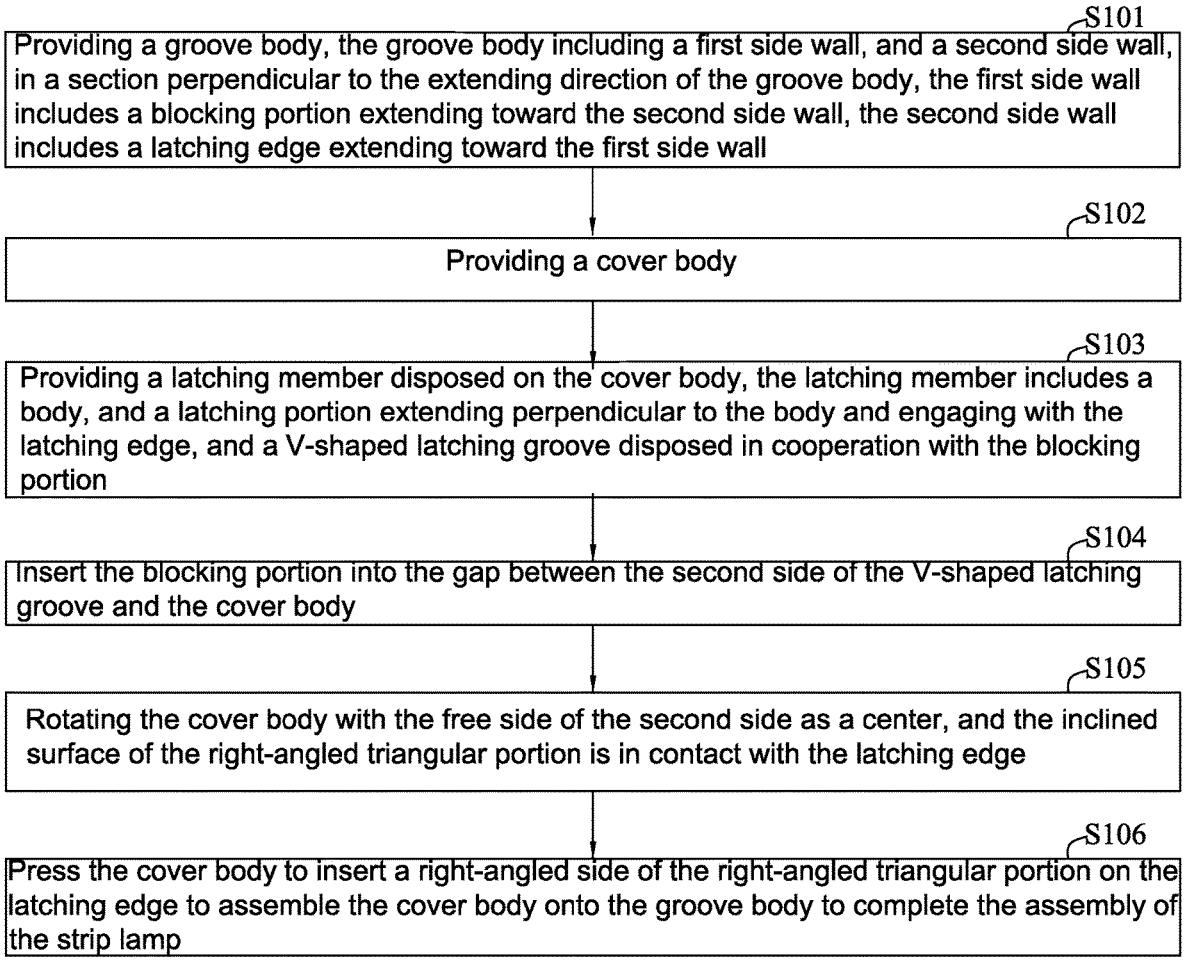
FIG. 4 is a flow chart of a method of assembling the strip lamp of FIG. 1.

Please refer to FIG. 4, which is a flow chart of the assembly method of the strip lamp 100, which includes the following steps:

S101: Providing a groove body 10, the groove body 10 including a first side wall 11, and a second side wall 12, in a section perpendicular to the extending direction of the groove body 10, the first side wall 11 includes a blocking portion 111 extending toward the second side wall 12, the second side wall 12 includes a latching edge 121 extending toward the first side wall 11;

S102: Providing a cover body 20;

S103: Providing a latching member 30 disposed on the cover body 20, the latching member 30 includes a body 31, and a latching portion 32 extending perpendicular to the body 31 and engaging with the latching edge 121, and a V-shaped latching groove 33 disposed in cooperation with the blocking portion 111;

S104: Insert the blocking portion 111 into the gap between the second side 332 of the V-shaped latching groove 33 and the cover body 20;

S105: Rotating the cover body 20 with the free side of the second side 332 as a center, and the inclined surface of the right-angled triangular portion 322 is in contact with the latching edge 121;

S106: Press the cover body 20 to insert a right-angled side of the right-angled triangular portion 322 on the latching edge 121 to assemble the cover body 20 onto the groove body 10 to complete the assembly of the strip lamp 100.

Figure 5:
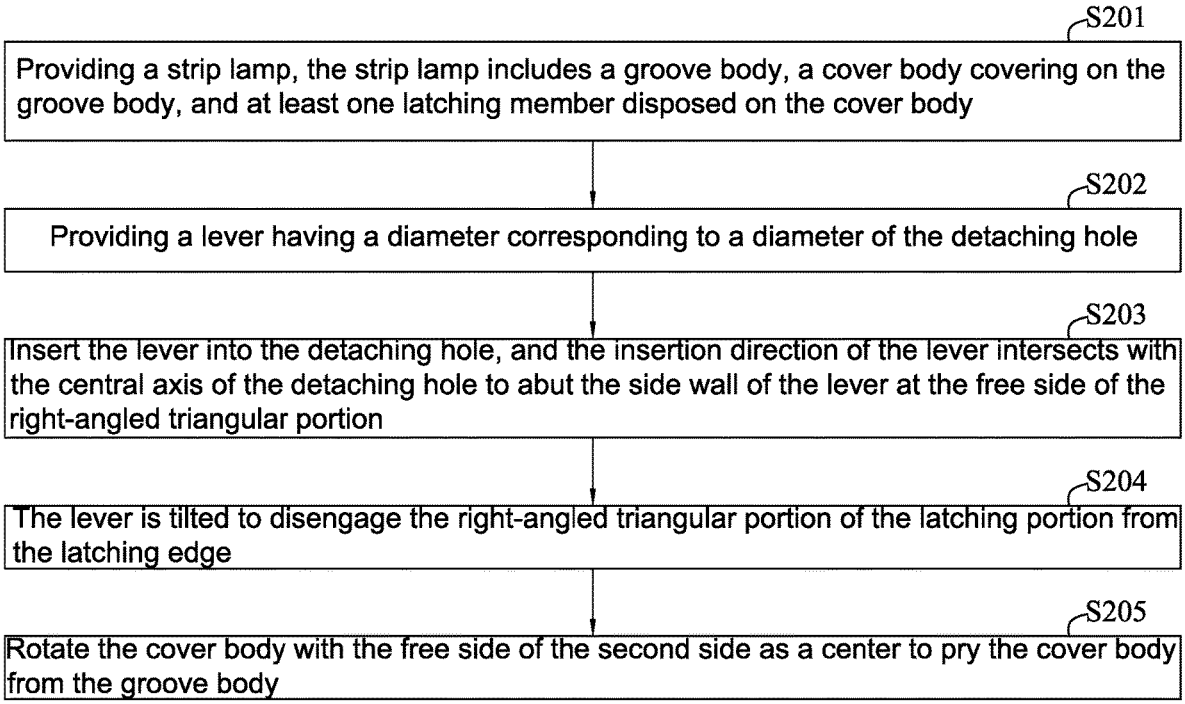
FIG. 5 is a flow chart of a method for disassembling the strip lamp of FIG. 1.

Please refer to FIG. 5, which is a flow chart of a disassembling method of the strip lamp 100, which includes the following steps:

S201: Providing a strip lamp 100, the strip lamp 100 includes a groove body 10, a cover body 20 covering on the groove body 10, and at least one latching member 30 disposed on the cover body 20;

S202: Providing a lever having a diameter corresponding to a diameter of the detaching hole 122;

S203: Insert the lever into the detaching hole 122, and the insertion direction of the lever 122 intersects with the central axis of the detaching hole 122 to abut the side wall of the lever at the free side of the right-angled triangular portion 322;

S204: The lever is tilted to disengage the right-angled triangular portion 322 of the latching portion 32 from the latching edge 121;

S205: Rotate the cover body 20 with the free side of the second side 332 as a center to pry the cover body 20 from the groove body 10.

After the cover body 20 is detached from the groove body 10, the functional modules placed on the groove body 10, such as the power module and the plug-in module, can be operated.

Compared with the prior art, since the first and second side walls 11 and 12 of the groove body 10 are respectively provided with the blocking portion 111, the latching member 30 is provided with the latching portion 32 and the V-shaped latching groove 33, so that the cover body 20 can cover the cover body 20 on the groove body 10 without any fasteners, so that the assembly method is simple and convenient, and it is convenient when disassembling, as long as one root lever is inserted into the detaching hole 122, so that the cover body 20 can be detached from one side of the groove body 10, and the other side of the groove body 10 is not detached by the V-shaped latching groove 33 and the blocking portion 111, thereby facilitating the installation and maintenance of the strip lamp 100.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. A strip lamp, comprising:

a groove body, a cover body covering the groove body, at least one latching member disposed on the cover body, the groove body includes a first side wall, and a second side wall, the first side wall includes a blocking portion extending toward the second side wall in a section perpendicular to an extending direction of the groove body, the second side wall includes a latching edge extending toward the first side wall, and the latching member includes a body, a latching portion extending perpendicular to the body and engaging with the latching edge, and a V-shaped latching groove provided in cooperation with the blocking portion, the latching portion includes a connecting edge connected to the body, and a right-angled triangular portion, a right-angled side of the right-angled triangular portion is connected to the connecting edge, an other right-angled side is engaged with the latching edge, the V-shaped latching groove is latched on the blocking portion and includes a first side connected to the body, and a second side connected to the first side, an angle between the first side and the body is an obtuse angle in a section perpendicular to the extending direction of the groove body, and the second side is spaced apart from the cover body.

2. The strip lamp as claimed in claim 1, wherein the connecting edge is perpendicular to the body.

3. The strip lamp as claimed in claim 1, wherein the first side wall further includes an abutting portion in a section perpendicular to the extending direction of the groove body, and a transition portion connecting the abutting portion and the blocking portion.

4. The strip lamp as claimed in claim 3, wherein the transition portion is an arc.

5. The strip lamp as claimed in claim 3, wherein an extending direction of the abutting portion is perpendicular to the extending direction of the blocking portion.

6. The strip lamp as claimed in claim 1, wherein a distance between the second side and the cover body is equivalent to a wall thickness of the blocking portion.

7. The strip lamp as claimed in claim 1, wherein a maximum distance of the blocking portion from the cover body is equivalent to a maximum distance of the latching portion from the cover body.

8. The strip lamp as claimed in claim 1, wherein the second side wall further includes at least one detaching hole, and a central axis of the detaching hole intersects a hypotenuse of the right-angled triangular portion in a section perpendicular to the extending direction of the groove body.

9. An assembly method of a strip lamp includes the following steps:

providing a groove body, the groove body including a first side wall, and a second side wall, in a section perpendicular to the extending direction of the groove body, the first side wall includes a blocking portion extending toward the second side wall, the second side wall includes a latching edge extending toward the first side wall;

providing a cover body;

providing a latching member disposed on the cover body, the latching member includes a body, and a latching portion extending perpendicular to the body and engaging with the latching edge, and a V-shaped latching groove disposed in cooperation with the blocking portion, the latching portion includes a connecting edge connected to the body, and a right-angled triangular portion, a right-angled side of the right-angled triangular portion is connected to the connecting edge, an other right-angled side is engaged with the latching edge, the V-shaped latching groove is latched on the blocking portion and includes a first side connected to the body, and a second side connected to the first side, an angle between the first side and the body is an obtuse angle in a section perpendicular to the extending direction of the groove body, and the second side is spaced apart from the cover body;

inserting the blocking portion into a gap between the second side of the V-shaped latching groove and the cover body;

rotating the cover body with a free side of the second side as a center, and the inclined surface of the right-angled triangular portion is in contact with the latching edge; and pressing the cover body to insert the other right-angled side of the right-angled triangular portion on the latching edge to assemble the cover body onto the groove body to complete the assembly of the strip lamp.

10. A disassembling method of a strip lamp includes the following steps:

providing a strip lamp, the strip lamp includes a groove body, a cover body covering on the groove body, and at least one latching member disposed on the cover body, the groove body includes a first side wall, and a second side wall, the first side wall includes a blocking portion extending toward the second side wall in a section perpendicular to an extending direction of the groove body, the second side wall includes a latching edge extending toward the first side wall, and the latching member includes a body, a latching portion extending perpendicular to the body and engaging with the latching edge, and a V-shaped latching groove provided in cooperation with the blocking portion, the latching portion includes a connecting edge connected to the body, and a right-angled triangular portion, a right-angled side of the right-angled triangular portion is connected to the connecting edge, an other right-angled side is engaged with the latching edge, the V-shaped latching groove is latched on the blocking portion and includes a first side connected to the body, and a second side connected to the first side, an angle between the first side and the body is an obtuse angle in a section perpendicular to the extending direction of the groove body, and the second side is spaced apart from the cover body, the second side wall further includes at least one detaching hole, and a central axis of the detaching hole intersects a hypotenuse of the right-angled triangular portion in a section perpendicular to an extending direction of the groove body;

providing a lever having a diameter corresponding to a diameter of the detaching hole;

inserting the lever into the detaching hole, and an insertion direction of the lever intersects with the central axis of the detaching hole to abut a side wall of the lever at a free side of the right-angled triangular portion;

tilting the lever to disengage the right-angled triangular portion of the latching portion from the latching edge; and rotating the cover body with a free side of the second side as a center to pry the cover body from the groove body.

* * * * *